United States Patent [19]

Naito

[11] 3,950,935

[45] Apr. 20, 1976

[54] CHRONOGRAPH WRISTWATCH

[75] Inventor: Okito Naito, Suwa, Japan

[73] Assignee: Kabushiki Kaisha Suwa Seikosha, Tokyo, Japan

[22] Filed: Sept. 24, 1973

[21] Appl. No.: 399,040

[30] Foreign Application Priority Data

Sept. 22, 1972 Japan ..... 47-94574

[52] U.S. Cl. ..... 58/39.5; 58/50 R; 58/74; 58/152 R

[51] Int. Cl.[2] ..... G04F 8/02; G04B 19/30; G04F 7/04; G04B 47/06

[58] Field of Search ..... 58/39.5, 50 R, 74, 152 R, 58/153

[56] References Cited

UNITED STATES PATENTS

| | | | |
|---|---|---|---|
| 3,646,751 | 3/1972 | Purland et al. | 58/152 R |
| 3,668,861 | 6/1972 | Mitsui | 58/50 R |
| 3,717,990 | 2/1973 | Fujita | 58/50 R |
| 3,745,761 | 7/1973 | Tsuruishi | 58/38 |
| 3,757,509 | 9/1973 | Fujita | 58/39.5 |
| 3,795,099 | 3/1974 | Tsuruishi | 58/50 R |
| 3,854,277 | 12/1974 | Samejima, et al. | 58/39.5 |

*Primary Examiner*—Edith Simmons Jackmon
*Attorney, Agent, or Firm*—Blum, Moscovitz, Friedman & Kaplan

[57] ABSTRACT

An electronic timepiece having a single digital display and being suitable to operate as a standard timekeeping wristwatch or in the alternative as a chronograph. Separate divider circuits are provided for performing the timekeeping and chronograph functions, a first selector circuit selecting which function is to be displayed. A single set of switches is provided for controlling either divider circuit, a second selected circuit selecting which function is performed by said switches.

8 Claims, 3 Drawing Figures

CHRONOGRAPH WRISTWATCH

BACKGROUND OF THE INVENTION

This invention relates generally to an electronic timepiece adapted to provide standard timekeeping and/or chronographic display and especially to an electronic wristwatch having a chronographic display controlled by the same switching mechanism that provides correction of the standard timekeeping display.

While chronographic wristwatches having stopwatch and measuring capabilities which also include timekeeping displays have taken on various forms, such wristwatches have been found to have various defects during normal operation. Particularly, when such chronographic wristwatches are mechanical and are used as a stopwatch, the hour and minute hands for displaying time are usually indistinguishable from those used for the stopwatch function. Moreover, because it is necessary to use the second hand as a stopwatch hand the accurate measuring of seconds during normal timekeeping cannot be maintained. Also, it is extremely difficult to measure exact time periods to a unit less than a second because of the small displacement of the second hand.

SUMMARY OF THE INVENTION

Generally speaking, in accordance with the invention, an electronic wristwatch is provided with a single digital display and electronic circuitry for providing conventional timekeeping or chronographic functions for selective display. A high frequency time standard signal is provided to both a chronographic divider means which produces low frequency chronographic signals representative of elapsed time and to a timekeeping divider means which produces low frequency time-keeping signals representative of present time. A first selector means is coupled to both divider means to receive the output thereof. Digital display means is coupled to the output signal of either of chronographic divider means or time-keeping divider means as selected by said first selection means. A single set of switches is provided for controlling the operation of either divider circuit. Second selector means interconnects said single set of switches and both said timekeeping and chronograph divider means for selecting which divider circuit means is controlled by said switches. A switch is provided for coordinately operating said first and second selection means.

Accordingly, it is an object of this invention to provide an improved digital display chronographic wristwatch.

Another object of the invention is to provide an improved digital display electronic chronographic wristwatch wherein the same switches are used to correct the time displayed and to control the chronographic use thereof.

A further object of the invention is to provide an improved chronographic wristwatch wherein the second display of standard time is in no way affected by the use of the wristwatch as a chronograph.

Still another object of the invention is to provide an improved wristwatch wherein the chronographic display is accurate to, and capable of displaying less than second units.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing in which.

DESCRIPTION OF THE PREFERRED EMBODIMENT

Figure 1:
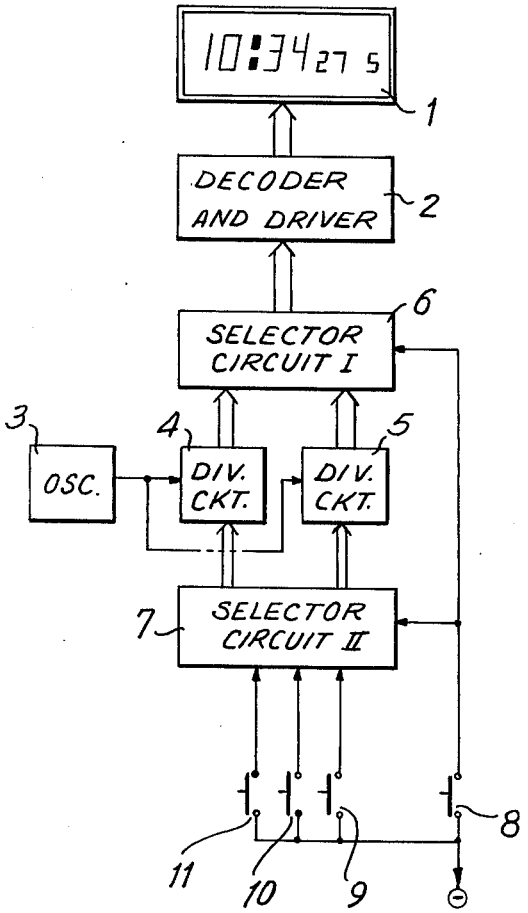
FIG. 1 is a block diagram of an electronic wristwatch circuit adapted to display either standard timekeeping information or chronographic information constructed in accordance with a preferred embodiment of the instant invention.
Figure 2:
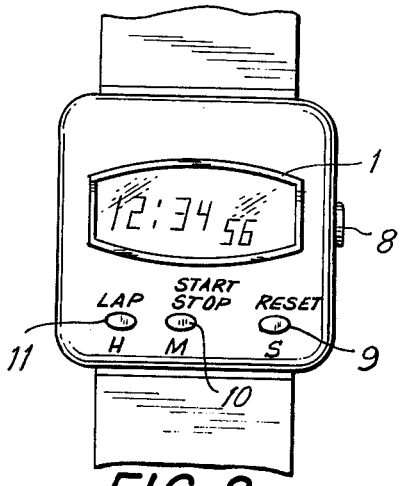
FIGS. 2 and 3 are perspective views of an electronic timepiece including the circuit of FIG. 1 respectively disposed in a standard time display and chronographic display mode.
Figure 3:
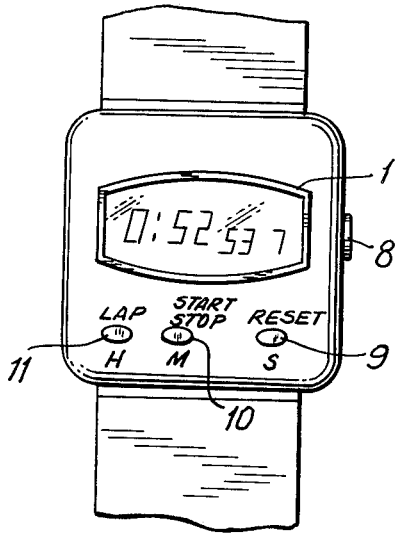

Referring now to FIGS. 1 through 3 an electronic timepiece having a conventional digital display such as a liquid crystal display, for displaying numerals representative of hours, minutes, seconds and tenths of a second is depicted. An oscillator circuit 3 which includes a quartz crystal vibrator, is coupled to a timekeeping divider circuit 4 and a chronographic divider circuit 5 for applying high frequency time standard signals thereto. The timekeeping divider circuit 4 consists of a multi-stage divider chain capable of counting seconds, minutes and hours and producing, as an output, timekeeping signals representative of present time as reflected by the count in the respective divider stages. The chronographic divider circuit 5 likewise consists of a multi-stage divider chain, but this circuit is capable of counting tenths of seconds, seconds, minutes and hours. The output of said chronograph divider circuit are chronograph signals representative of the time being measured as reflected by the count of the respective divider stages. The outputs of timekeeping divider circuit 4 and chronographic divider circuit 5 are supplied to a first selector circuit 6. The digital display 1 is coupled to first selector circuit 6 by decoder and driver circuit 2 which operates the digital display in response to the low frequency signals applied thereto by first selector circuit 6. The first selector circuit applies either to the output of chronographic divider circuit 5 or the output of timekeeping divider circuit 4 to decoder and driver circuit 2 in response to the setting of mode switch 8 in one of an open or closed position, to thereby display either elapsed or present time. The second selector circuit 7 is connected between control switches 9, 10 and 11 and both timekeeping divider circuit 4 and chronographic divider circuit 5 and is further connected to mode switch 8 for operation thereby. Second selector circuit 7 selectively connects switches 9, 10 and 11 to either of the divider circuits in response to the setting of mode switch 8 in one of an open or closed position coordinate with the operation of first selector circuit 6.

When mode switch 8 disposes second selector circuit 7 so that control switches 9, 10 and 11 are connected to timekeeping divider circuit 4, said switches serve as time correction switches, being respectively connected to the divider stages producing the second, minute and hour signals respectively for the separate correction of said divider stages to selectively correct the second, minute or hour time indication displayed by display 1. The correction may be achieved by indexing the count of the associated divider stage by one upon each operation of control switches 9, 10 and 11. The control switches 9, 10 and 11 may be connected to the associated timekeeping divider stages by any known arrangement including, by way of example, the arrangement depicted in U.S. Pat. No. 3,717,990.

As is depicted in FIG. 2, when mode switch 8 is in a first position, the wristwatch is adapted to display present time in response to the output of timekeeping divider circuit 4, while control switches 9, 10 and 11 are connected to said divider circuit by second selector circuit 7. Thus, as is depicted in FIG. 2, time in hours, minutes and seconds is displayed by digital display 1 and if the incorrect time is displayed thereby, such correction thereof is easily effected by control switches 9, 10 and 11.

On the other hand, when it is desired to utilize the timepiece as a chronograph, mode switch 8 is placed in its second position thus activating first selector circuit 6 to supply the low frequency signal output of chronographic divider circuit 5 to display 1 and to further couple control switches 9, 10 and 11 through second selector circuit 7 to said chronographic divider means. As depicted in FIG. 3, control switches 9, 10 and 11 respectively perform the reset, start-stop and lap control functions when mode switch 8 is disposed in the chronograph position.

In the chronograph mode, control switch 9 is connected to the divider stages of chronographic divider circuit 5 to reset and divider stages to zero; control switch 10 is connected to said divider stages to selectively start and stop the operation of said chronographic divider circuit to perform the chronograph function; and control switch 11 is connected to said divider stages to apply the instantaneous output of the chronographic divider circuit stages to display 1 and to hold the resultant elapsed time display while the chronograph divider circuit continues the count (the elapsed time of a lap). The connection of control switches 9, 10 and 11 to the divider stages of chronographic divider circuit 5 to perform the foregoing functions in connection therewith may take any prior art form, as by way of example, the connections of the reset, start and stop, and lap control switches depicted in U.S. Pat. No. 3,795,099, which patent corresponds to Japanese Patent Application No. 46/7160, filed Feb. 18, 1971 and laid open for public inspection on Sept. 26, 1972.

Thus, the same digital display is used to display both present time as in the case of a normal timepiece and elapsed time as in a chronograph while a single set of switches controls both functions, while selection of function is by the mere operation of a mode switch 8.

Selector Circuits I and II may be formed of logic gates for performing the described functions as is well known in the art, and as exemplified by the AND gates 32 and 33, OR gates 34 and inverter 31 associated with selection siwtch 30 of U.S. Pat. No. 3,745,761, and AND gates 20 and 21, OR gate 22 and inverter 19 controlled by selector switch WC of U.S. Pat. No. 3,795,099.

As is understood, because the digital display during timekeeping is completely independent of the digital display during chronographic operation the problems of misreading information are eliminated. Also, present time can be displayed to the second while, when the timepiece is changed over to operate as a stop watch or chronograph, elapsed time to tenths of a second can be displayed. Moreover, the switching over of the timepiece to a chronographic operation in on way affects the timekeeping divider circuit so that when the timepiece is changed back to normal timekeeping operation, the seconds display remains accurate, a feature which, as pointed out above, is difficult to attain in mechanical watches, wherein the second hand is used for the stop watch function.

As is further understood, all the electronic circuits according to this invention can be realized by forming integrated circuits having C-MOS transistors. The first and second selector switches may each consist of a C-MOS switching circuit actuated by mode switch 8. Thus, a timepiece is provided which when used as a stop watch has a control function including reset, start-stop and lap time which are necessary in stop watch mechanisms, and in a timekeeping operation contains correction switches, said correction switches and control switches being the same, to thereby minimize space. Thus a digital chronograph wristwatch occupying minimal space and utilizing minimal power, features which are necessary for commercialization thereof, and at the same time eliminating problems which have existed in mechanical chronographic wristwatches, can be easily manufactured.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece comprising oscillator means for generating a relatively high frequency time standard signal; chronographic divider means coupled to said oscillator means and adapted to produce low frequency chronographic signals representative of elapsed time in response to said time standard signal; timekeeping divider means coupled to said oscillator means and adapted to produce low frequency timekeeping signals representative of present time in response to said time standard signal; first selector means coupled to said chronographic divider means for receiving said chronographic signals and to said timekeeping divider means for receiving said timekeeping signals, said first selector means having an output to which one of said chronographic signals or timekeeping signals are selectively applied; digital display means coupled to the output of said first selector means for displaying either elapsed or present time dependent on the signals applied to said first selector means; at least one manually operable control switch; and second selector means for selectively coupling said control switch to either said chronographic divider means or said timekeeping divider means, said divider means both being adapted for control by said control switch when coupled thereto by said second selector means, and a single, manually operable mode switch operably coupled to both said first and second selector means for coordinately setting said selector means so that said control switch is coupled to one of said divider means when said display means displays a time representative of the signal produced by said one divider means.

2. An electronic timepiece as recited in claim 1, wherein said control switch corrects the timekeeping signals to correct the displayed present time when coupled to the timekeeping divider means by said second selector means.

3. An electronic timepiece as recited in claim 2, wherein said digital display means displays hours, minutes and seconds of present time and including at least three control switches respectively correcting the display of hours, seconds and minutes when coupled to said timekeeping means by said second selector means.

4. An electronic timepiece as recited in claim 3, wherein said three control means respectively control reset, stop-start and lap time functions when coupled to the chronographic divider means by said second selector means.

5. An electronic timepiece as recited in claim 3, wherein said digital display means displays hours, minutes, seconds and tenths of seconds of elapsed time when said chronographic signals are applied to the output of said first selector means.

6. An electronic timepiece as recited in claim 1, wherein said oscillator means is a crystal oscillator.

7. An electronic timepiece as recited in claim 1, wherein said digital display means includes a liquid crystal display.

8. An electronic timepiece as claimed in claim 1, wherein said display means includes a solid state display.

* * * * *